United States Patent [19]

Zaccheroni

[11] Patent Number: 4,509,453

[45] Date of Patent: Apr. 9, 1985

[54] APPARATUS FOR CONTINUOUSLY DIP-ZINCING OF METALLIC WIRE OR STRIP MATERIAL

[76] Inventor: Giulio Zaccheroni, Via della Grada 6, Bologna, Italy

[21] Appl. No.: 445,634

[22] Filed: Nov. 30, 1982

[30] Foreign Application Priority Data

Nov. 30, 1981 [IT] Italy ..... 3591 A/81

[51] Int. Cl.[3] ..... B05C 3/12

[52] U.S. Cl. ..... 118/420; 118/427; 118/428; 118/429; 427/434.4; 427/437.6

[58] Field of Search ..... 118/420, 428, 427, 429, 118/500; 427/434.4, 434.6

[56] References Cited

U.S. PATENT DOCUMENTS

| | | | |
|---|---|---|---|
| 3,091,217 | 5/1963 | Seymour | 118/420 |
| 3,570,455 | 3/1971 | Laidman et al. | 118/428 |
| 4,190,017 | 2/1980 | Bizik | 118/74 |

*Primary Examiner*—John E. Kittle
*Assistant Examiner*—James J. Seidleck
*Attorney, Agent, or Firm*—Pollock, Vande Sande & Priddy

[57] ABSTRACT

The material 3 to be coated with zinc is passed through a zinc melt bath 2 contained in a tub 1 and is kept immersed in said bath by a return guide member 5, at the downstream side of which the materials exits from the tub 1 in a substantially vertical direction.

The return guide member 5 consists of a body of elongate shape extending transversely of the longitudinal direction of the tub 1.

The return guide member 5 consists of a heat-resistant material which is resistant to temperatures of the order of at least 450° C. to 500° C., has zinc melt repellent properties and is corrosion-resistant under the attack of the zinc melt. It is of substantially pear-shaped cross-sectional configuration with its upper end formed so as to permit its being attached to a retainer clamp 8 in a dovetail connection. The clamp itself is adjustably connected to a transverse carrier structure mounted for pivotal movement about a horizontal axis 19.

The lower portion of the return guide member 5 immersed in the bath 2 has a cross-sectional profile comprising a combination of concentrically arcuate guide surfaces 6 alternating with longitudinal grooves 7 extending over the full length of the return guide member 5.

6 Claims, 4 Drawing Figures

APPARATUS FOR CONTINUOUSLY DIP-ZINCING OF METALLIC WIRE OR STRIP MATERIAL

Figure 1:
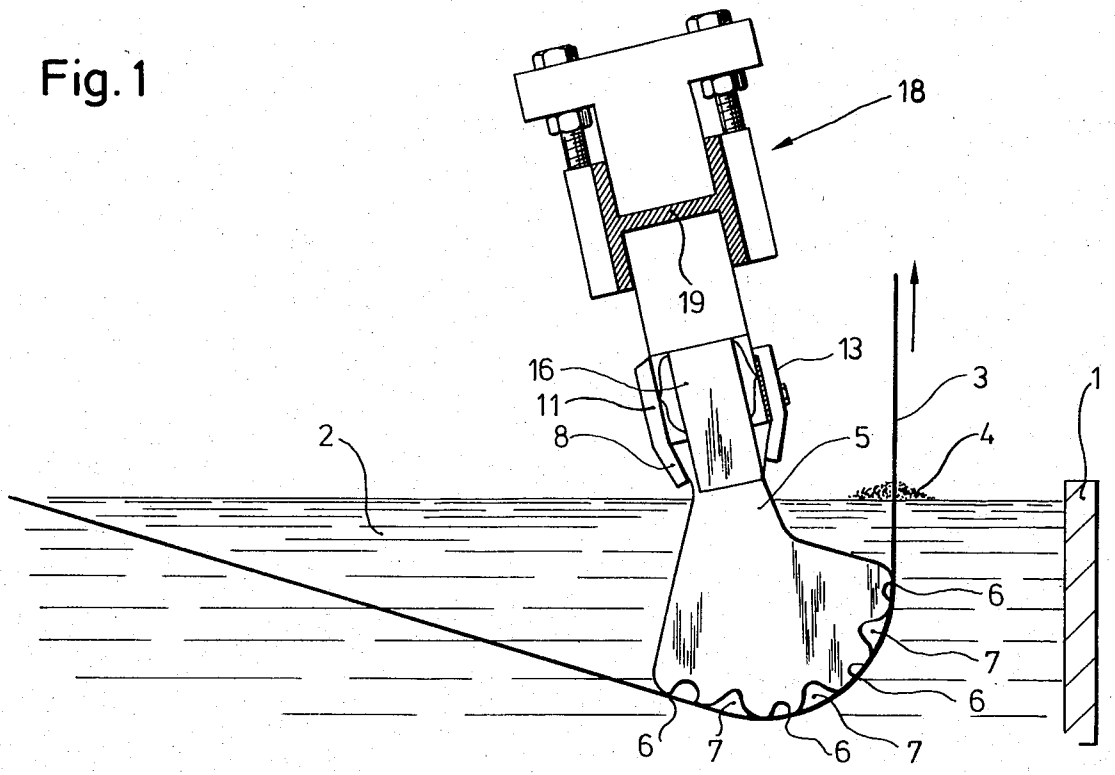

This invention relates to apparatus for continuously dip-zincing, particularly thick-layer zincing, of metallic wire, strip or similar material in a molten zinc dip bath.

Dip-zincing of this kind is generally carried out in such a manner that the continuous material to be dip-zinced is guided around a return sheave within the bath, whereupon the material leaves the bath vertically upwards at the downstream side of the sheave.

The sheave is usually manufactured of particularly pure Armco steel or S.M steel and has a pair of axle pins supported for rotation in graphite bushings. The sheave itself as well as the bearing bushings are subjected to rapid corrosion within the zinc bath, which corrosion is additionally promoted by the rotation of the sheave in the molten zinc bath. The corrosion and the wear phenomena resulting therefrom give rise to vibrations which are transmitted to the material to be treated so as to detrimentally affect the uniformity of the applied coating and its surface finish.

The movement of the molten zinc within the bath caused by the rotation of the sheave prevents the material to be zinc-coated from being moved through the bath at elevated speeds with the aim of a more economical production, without adversely affecting the coating thickness and the surface finish of the zinced product in the process.

The known apparatus does not either permit simultaneous treatment of wires of different diameters, as this would require different speeds of the individual wires moving through the bath for obtaining coatings having similar and uniform properties. Furthermore it is not possible to simultaneously apply thick coatings and thin coatings to individual wires, as the material to be coated with a thick layer has to be moved through the bath at a lower speed than the material to be coated with a thin layer.

Due to the wear of moving parts, the apparatus has to be frequently stopped for repair and maintenance work.

In the known apparatus it is finally not possible to reconcile the requirement to impart an optimum curvature to the surface of the return guide element cooperating with the material to be treated, with the requirement that the material be not immersed too deeply into the bath, so that the material comes into contact with the highest-purity layer of the molten zinc bath for obtaining a superior quality coating.

It is therefore an object of the invention to improve an apparatus of the type described so as to eliminate the discussed disadvantages by forming the return guide member in such a manner that a uniform and extremely smooth coating is formed on the material to be zinc-coated, while permitting the material to be guided at elevated speeds through those layers of the dip bath in which the molten zinc is of highest purity. The apparatus shall further permit various types of material of different thickness or diameter to be treated simultaneously. It is a further object to prevent the return guide member from being corrosively affected by the molten zinc, so that the necessity of repair and maintenance work is reduced to a minimum amd the material passing through the bath is not subjected to vibrations.

In an apparatus as defined in the generic clause of the main claim, these and other objects are attained according to the invention by providing that the return guide member is stationary and comprises a plurality of separate guide surfaces cooperating with one another to define the path of the material through the bath. The guide surfaces extend transverse to the running direction of the material.

In a preferred embodiment the invention provides that the return guide member consists of a refractory material which is resistant to the action of the molten zinc, resistant against temperatures of the magnitude of at least 450° C. to 500° C., has zinc-melt repellent properties and is corrosion resistant under attack of the zinc melt.

In an advantageous embodiment of the invention, the return guide member is of elongate shape extending transversely of the longitudinal direction of a tub containing the zinc bath, the portion of said guide member immersed into the bath comprising a plurality of coaxially arcuate guide surfaces having outwards facing guide surface portions separated from one another by longitudinal grooves.

In accordance with a further aspect, the invention provides that the portion of the return guide member projecting above the bath has its free end formed with a cross-sectional shape permitting the return guide member to be affixed to a fixing clamp by a dovetail connection, said fixing clamp being adapted to be adjustably attached to a transverse carrier beam itself mounted for pivotal movement about a horizontal axis.

Figure 3:
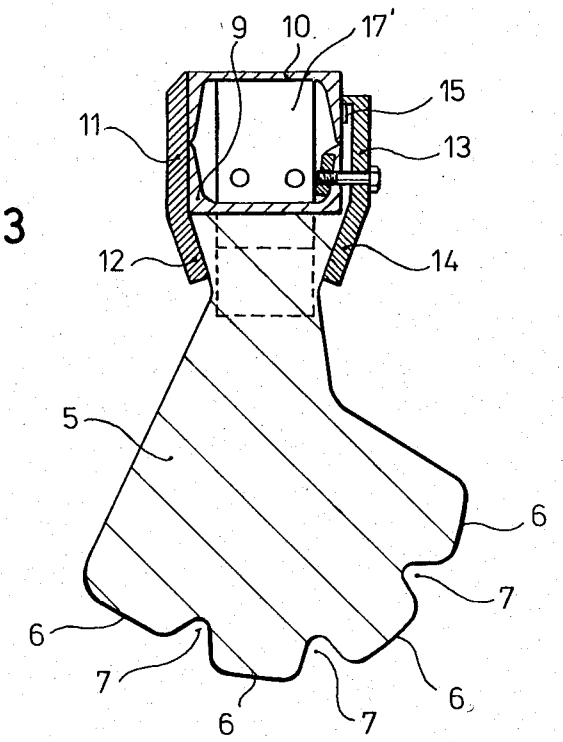
Figure 2:
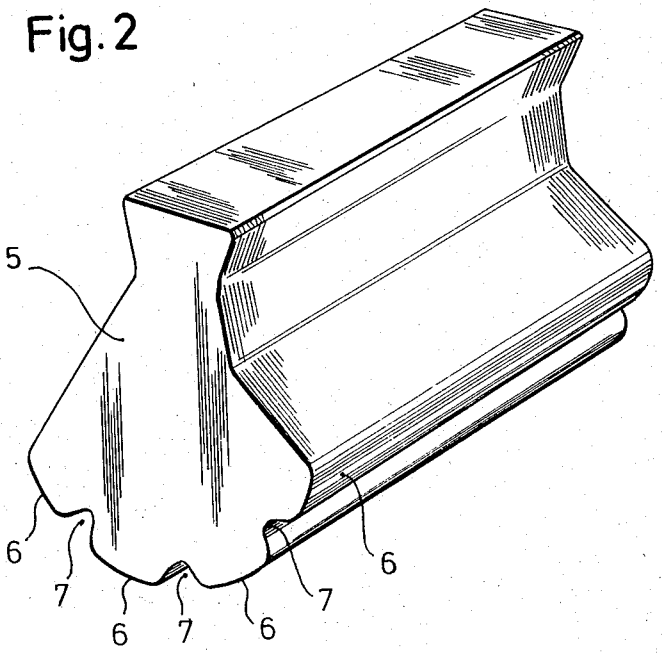
Figure 4:
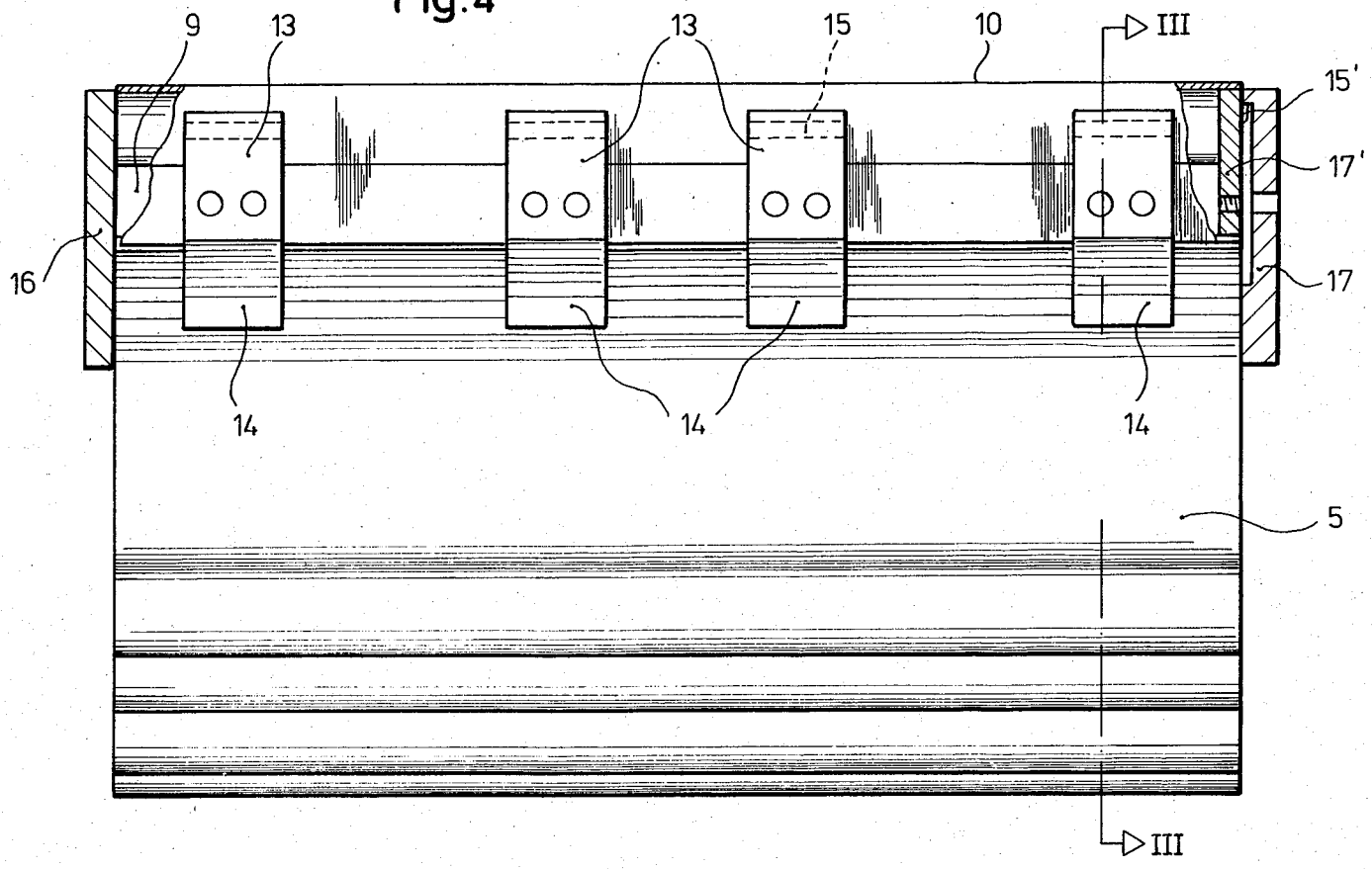

Further characteristics and advantages of the invention will become evident from the following description of a preferred embodiment with reference to the accompanying drawings, wherein:

FIG. 1 shows a partially sectioned side view of an apparatus for thick-layer zinc-coating a continuous material in a zinc melt dip bath, FIG. 2 shows an enlarged-scale perspective view of the return guide member, FIG. 3 shows a cross-sectional view of the return guide member shown in FIG. 2, together with a transverse carrier beam on which it is mounted, and FIG. 4 shows a partially sectioned side view of the return guide member shown in FIG. 3, together with the transverse carrier beam.

Shown in FIG. 1 in diagrammatic form is a tub 1 containing a bath 2 of a zinc melt with a plurality of parallel wires 3 of iron passing therethrough. The entry angle of the wires 3 with respect to the surface of bath 2 is an acute angle. After wires 3 have penetrated to a predetermined depth within bath 2, they are redirected in an upward direction so as to exit from bath 2 substantially vertically through a ground carbon layer 4. The redirection of wires 3 is accomplished by means of a return guide member 5 immersed in bath 2 and being selectively of one-piece construction or assembled of a plurality of elements. Member 5 consists of a ceramic material which is resistant to temperatures in the range of at least 450° C. to 500° C., has zinc-melt repellent properties and is corrosion-resistant under the attack of the zinc melt.

A material having these properties is for instance the material sold under the designation CARBAL 130 by the Italian firm SIRMA S.p.A. of Sassuolo, province of Modena.

Return guide member 5 extends transversely of the longitudinal direction of tub 1 and is partially immersed in bath 2.

The portion of member 5 immersed in bath 2 is formed with a plurality of outwardly facing, coaxially arcuate guide surfaces 6 separated from one another by longitudinal grooves 7. These surfaces extend transverse to the running direction of material (wire) undergoing coating. The profile of grooves 7 mates with the profile of guide surfaces 6 in such a manner that there are no sharp edges.

The portion of return guide member 5 projecting above bath 2 has its free end formed in such a manner that it may be fixedly attached to a fixing clamp 8 in a dovetail connection as particularly shown in FIGS. 2 to 4. Clamp 8 comprises a pair of interconnected C-section bars 9 and 10 extending transversely of tub 1. Bars 9 and 10 are welded to one another so as to result in a box-shaped body. Fixedly attached to one vertical side of this body is a plurality of but straps 11 having projecting tongues 12 extending at an inwards directed angle with respect to the longitudinal symmetry plane of the body. Attached to the other vertical wall of the body is a further plurality of similar but straps 13 also formed with tongues 14 extending at an angle towards said symmetry plane. Adjacent their upper ends straps 13 are formed with flanges for engagement with a ledge 15 projecting from one side of C-section bar 10. This facilitates correct attachment of straps 13 to the box-shaped body 9, 10 at the proper locations by means of bolts. At its opposite longitudinal ends, box-shaped body 9, 10 is provided with lateral retainer plates 16 and 17, of which retainer plate 16 is welded to the respective end of the box-shaped body, while the other plate 17 is attached to the other end in a manner similar to the attachment of but straps 13. The end of box-shaped body 9, 10 opposite to retainer plate 16 is closed by a plate 17' formed with a projecting ledge 15' for aligning retainer plate 17 at a predetermined level.

For affixing return guide member 5 to clamp 8, retainer plate 17 and but straps 13 are removed from box-shaped body 9, 10, whereupon the upper portion of guide member 5, which has the shape of an inverted equilateral trapeze, is inserted into clamp 8 in such a manner that one inclined side of the trapeze is engaged by the inwards angled tongues 12 of straps 11. The guide member 5 may then be fixed in this position by means of but straps 13 and retainer plate 17.

The attachment of return guide member 5 is accomplished in the same manner if it is composed of a plurality of elements having identical cross-sectional shape and being arranged in alignment with one another.

The upper portion of clamp 8 is fixedly attached to a transverse carrier structure 18 devised to permit height adjustment of clamp 8 and thus, of return guide member 5.

Carrier structure 18 itself is by per se known means (not shown) mounted on the apparatus for pivotal movement amout a horizontal axis 19, means being provided for locking the carrier structure in any angular position.

This offers the possibility to selectively adjust the inclination of the longitudinal center plane of return guide body 5, with respect to which the upper portion projecting above bath 2 is symmetric, while the lower portion formed by the arcuate guide surfaces 6 is slightly asymmetric with respect thereto. It is these guide surfaces 6 over which the material to be treated is guided during the zinc-coating process.

During the zinc-coating process the wires 3 or similar material provenient from an upstream treatment station, for instance from a Sendzimir treatment station, are kept immersed in bath 2 by return guide member 5. Since the arcuate guide surfaces 6 are separated from one another by longitudinal grooves 7, wires 3 are able to slide over subsequent guide surfaces 6 without the occurrence of friction, vibration or wear.

The zinc melt adhering to wires 3 acts as a lubricant practically eliminating any friction between the wires and the contact zones with return guide member 5.

Although the contact pressure between wires 3 and guide surfaces 6 might lead to the danger of the zinc melt adhering to the wires being stripped off, this occurrence is avoided by selecting the length of the contact zones between wires 3 and guide surfaces 6 such that the wires come into full surface contact with the zinc melt of bath 2 in the region of grooves 7 before the zinc melt acting as a lubricant is completely stripped off the wires. In this manner the zinc layers acting as a lubricant in the contact zones between wires 3 and guide surfaces 6 are immediately regenerated.

This ensures that wires 3 slide over guide surfaces 6 of return guide member 5 without the occurrence of vibration and friction, while return guide member 5 keeps the wires immersed in bath 2 without the occurence of frictional wear, as the zinc layer, acting as a lubricant, reduces the friction due to contact between the wires and the guide surfaces 6 of return guide member 5 to a minimum. Downstream of the last guide surface, wires 3 leave return guide member 5 in a substantially vertical direction before exiting from bath 2 through the ground carbon layer 4 on the surface thereof.

In practicing the invention it has been found that a return guide member 5 having the properties as defined by this invention may be employed for a continuous period of ten months or above for thick-layer zinc-coating iron wire of a diameter between 1.8 and 5.4 mm without having at any time to be removed from the zinc melt bath of an installation for the simultaneous thick-layer zinc-coating of twenty-eight wires.

An inspection of the return guide body after this period of employ did not show any wear of the member.

In comparison to conventional thick-layer zinc-coating installations equipped with return sheaves or rollers, the apparatus according to the invention has been found to be very economical, as the costs for repair and maintenance work as well as the costs due to production stoppage caused by extended stop periods of the installation can be practically eliminated.

Moreover it was found that the wire coating was of remarkably improved quality as compared to that of wires treated in a conventional installation.

Within the scope of the invention, various modifications are of course possible without thereby leaving the spirit of the invention. Thus the return guide member may be formed as a longitudinally sectioned body or assembled of a plurality of stationary and rigid guide elements. Such guide elements may consist of tubular or similar bars mounted parallel to one another in spaced relationship on opposite walls of the tub or by other means in such a manner that the material to be coated is guided through the bath along the desired path so as to alternately contact the guide bars and the zinc melt.

I claim:

1. Apparatus for continuously zinc-coating metallic wire, strip material or the like in a zinc melt dip bath, comprising a stationary return guide member at least partially immersed in said bath for guiding the material to be zinc-coated therethrough and redirecting it substantially vertically upwards, said return guide member (5) comprising a plurality of separate guide surfaces (6) extending transversely to the running direction of said material (3) and cooperating to define the path of the material through said bath (2).

2. Apparatus according to claim 1, characterized in that said return guide member (5) consists of a heat-resistant material which is capable of withstanding immersion in the zinc melt, resistant to temperatures in the order of at least 450° C. to 500° C., has zinc melt repellent properties and is corrosion-resistant under the attack of the zinc melt.

3. Apparatus for continuously zinc-coating metallic wire, strip material or the like in a zinc melt dip bath, comprising a return guide member at least partially immersed in said bath for guiding the material to be zinc-coated therethrough and redirecting it substantially vertically upwards, characterized in that said return guide member (5) is stationary and comprises a plurality of separate guide surfaces (6) cooperating to define the path of said material (3) through said bath (2) wherein said return guide member (5) is of elongate shape extending transversely of the longitudinal direction of a tub (1) containing said bath (2), and has its portion immersed in said bath (2) formed with a plurality of coaxially arcuate guide surfaces (6) the convex surface portions of which are directed towards the outer periphery of the return guide member (5) and separated from one another by longitudinal grooves (7).

4. Apparatus according to claim 1, characterized in that the portion of said return guide member (5) projecting above said bath (2) has its free end formed so as to permit its being attached to a retainer clamp (18) with a dovetail connection, said retainer clamp itself being displaceably attached to a transverse carrier structure (18) mounted for pivotal adjustment about a horizontal axis (19) and adapted to be locked at a desired angular position.

5. Apparatus according to claim 1, characterized in that said return guide member (5) is of one-piece construction.

6. Apparatus according to claim 1, characterized in that said return guide member (5) is assembled of a plurality of elements.

* * * * *